US009227642B2

(12) United States Patent
Huntimer et al.

(10) Patent No.: US 9,227,642 B2
(45) Date of Patent: Jan. 5, 2016

(54) TRAIN DETECTION SYSTEMS AND METHODS

(71) Applicants: Todd M. Huntimer, Arlington, SD (US); Coleen Liebsch, Arlington, SD (US)

(72) Inventors: Todd M. Huntimer, Arlington, SD (US); Coleen Liebsch, Arlington, SD (US)

( * ) Notice: Subject to any disclaimer, the term of this patent is extended or adjusted under 35 U.S.C. 154(b) by 281 days.

(21) Appl. No.: 13/846,063

(22) Filed: Mar. 18, 2013

(65) Prior Publication Data

US 2014/0263857 A1 Sep. 18, 2014

(51) Int. Cl.

| | |
|---|---|
| ***B61L 25/00*** | (2006.01) |
| ***B61L 25/02*** | (2006.01) |
| ***B61L 29/24*** | (2006.01) |

(52) U.S. Cl.

CPC ..... *B61L 25/025* (2013.01); *B61L 29/246* (2013.01); *B61L 2205/04* (2013.01)

(58) Field of Classification Search

CPC ..... B61L 29/24; B61L 29/246; B61L 29/18; B61L 29/00; B61L 29/32; B61L 25/025; B61L 25/02; B61L 25/021; B61L 2205/04; B61L 1/188; B61L 27/0088; B61L 3/221

See application file for complete search history.

(56) References Cited

U.S. PATENT DOCUMENTS

| | | | | |
|---|---|---|---|---|
| 6,179,252 | B1 * | 1/2001 | Roop et al. | 246/293 |
| 7,196,636 | B2 * | 3/2007 | Graham | 340/933 |
| 7,315,770 | B2 * | 1/2008 | Wade et al. | 701/19 |
| 7,769,544 | B2 * | 8/2010 | Blesener et al. | 701/301 |
| 7,772,996 | B2 * | 8/2010 | Burns | 340/991 |
| 8,297,558 | B2 * | 10/2012 | O'Dell et al. | 246/126 |
| 8,630,757 | B2 * | 1/2014 | Daum et al. | 701/19 |
| 8,838,301 | B2 * | 9/2014 | Makkinejad | 701/19 |
| 2011/0084176 | A1 * | 4/2011 | Reichelt et al. | 246/473.1 |
| 2011/0095139 | A1 * | 4/2011 | O'Dell | 246/293 |
| 2014/0012438 | A1 * | 1/2014 | Shoppa et al. | 701/19 |
| 2014/0263857 | A1 * | 9/2014 | Huntimer et al. | 246/122 R |

* cited by examiner

*Primary Examiner* — Jason C Smith

(74) *Attorney, Agent, or Firm* — Darren J. Jones; Lowe Graham Jones PLLC

(57) ABSTRACT

Techniques for improving safety at railroad track crossings are described. Example embodiments provide a train detection and collision avoidance system configured to detect potential collisions between vehicles (e.g., cars, trucks, motorcycles) and trains. The system detects potential collisions based on location information obtained by tracking modules installed in or carried by the trains and vehicles. When a potential collision between a vehicle and a train is detected, the train detection system alerts an operator of the vehicle and/or the train, so that the operator can take steps to avoid the collision. The operator may be alerted in various ways, including by audio, visual, or tactile output.

14 Claims, 5 Drawing Sheets

TRAIN DETECTION SYSTEMS AND METHODS

FIELD OF THE INVENTION

The present disclosure relates to methods and systems for train safety and, more particularly, to methods and systems for reducing and preventing collisions between trains and vehicles at railroad crossings, such as by detecting and alerting drivers of potential collisions based on location information obtained from trains and vehicles.

BACKGROUND

Many vehicle drivers fail to heed warnings or to take proper safety precautions when traveling over uncontrolled railroad crossings. In 2009, there were 1,896 crashes at public railroad crossings in the United States, many with catastrophic consequences. More than 10% of these crashes were fatal, resulting in 247 deaths. The rate of fatal accidents at railroad crossings is significantly higher than the overall automobile accident fatality rate of 0.6%.

There are more than 250,000 public and private crossings in the United States. The sheer number of crossings makes the task of reducing and preventing railroad crossing crashes daunting. Of approximately 140,000 public at-grade crossings in the United States, fewer than half are equipped with traffic control devices, such as gates (31%), flashing lights (16%), traffic signals, wigwags, bells, or the like. Put another way, over the half (52%) of the public railroad crossings are not equipped with any traffic control devices at all. These uncontrolled crossings were, are, and continue to be a threat to public safety and health. It is cost-prohibitive to upgrade or install traffic control devices at all public crossings.

SUMMARY

One embodiment provides a system configured to facilitate detection and avoidance of potential collisions between trains and vehicles. The system comprises a first tracking module carried by a train; and a train-detection module that is carried by a vehicle and that includes a vehicle positioning system receiver. The train-detection module is configured to receive train location information from the first tracking module; determine vehicle location information based on information provided by the vehicle positioning system receiver; determine, based on the train location information and the vehicle location information, whether the train and the vehicle are likely to collide (or at some risk of collision); and when it is determined that the train and the vehicle are likely to collide, alert an operator of the vehicle of a potential collision with the train.

Another embodiment provides a method for facilitating detection and avoidance of potential collisions between trains and vehicles. The method comprises determining a predicted path of a train, based on train location information provided by a tracking module carried by the train; determining a predicted path of a vehicle, based on vehicle location information provided by a train-detection module carried by the vehicle; and alerting, based on the predicted paths, an operator of the vehicle of a potential collision with the train.

A further embodiment provides a computer-readable medium that includes instructions that are configured, when executed, to perform a method such as the one described above.

BRIEF DESCRIPTION OF THE DRAWINGS

Preferred and alternative examples of the present invention are described in detail below with reference to the following drawings.

DETAILED DESCRIPTION

Embodiments described herein provide enhanced computer- and network-based methods and systems for train detection and collision avoidance. Example embodiments provide a train detection system configured to detect potential collisions between vehicles (e.g., cars, trucks, motorcycles) and trains. When a potential collision between a vehicle and a train is detected, the train detection system alerts the operator of the vehicle and/or the train, so that the operator can take steps to avoid the collision. The operator may be alerted in various ways, including by audio (e.g., bell, voice), visual (e.g., flashing light), or tactile (e.g., steering wheel vibration) output.

Figure 1:
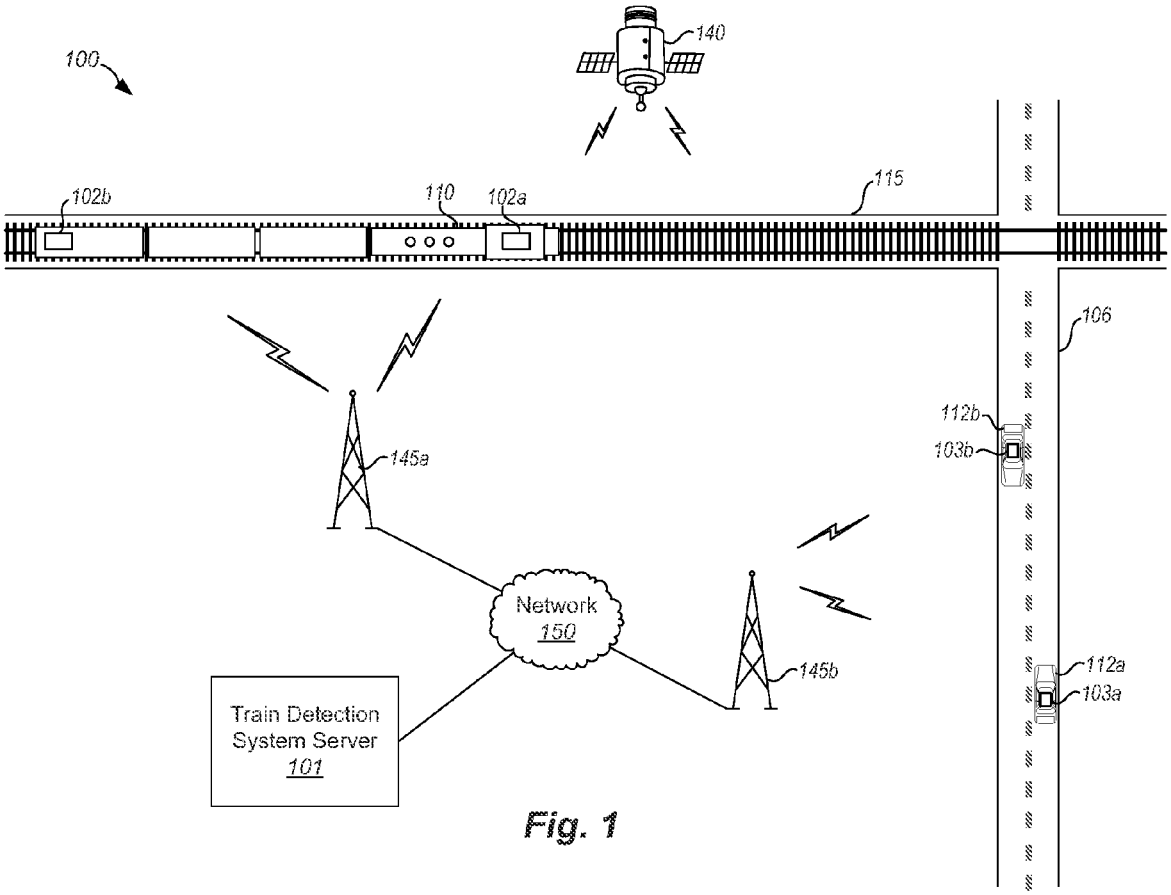
FIG. 1 illustrates operation of an example embodiment of a train detection system.

FIG. 1 illustrates operation of an example embodiment of a train detection system 100. The train detection system 100 is operating to detect potential collisions between vehicles and trains. In the illustrated example, a train 110 is traveling along a track 115. In addition, vehicles 112*a* and 112*b* are traveling along a road 106. The track 115 and the road 106 intersect, giving rise to potential vehicle-train collisions that may be detected and avoided by operation of the train detection system 100.

The train detection system 100 includes a train detection system server 101. The server 101 is configured to receive location information from the train 110. In particular, the train 110 includes train-tracking modules 102*a* and 102*b* that are each configured to transmit location information to the train detection system server 101. The tracking module 102*a* is located at or about the locomotive of the train 110. The tracking module 102*b* is located at or about the caboose or last car of the train 110. Each of the tracking modules 102 are configured to determine a current location, such as based on information received from a GPS ("Global Positioning System") satellite 140 or some other source (e.g., a network location provided by a cell tower or wireless access point). Any of such sources generally referred to herein as a "vehicle positioning system receiver". The tracking modules 102 are further configured to wirelessly communicate their determined location information to the server 101 via antennas 145*a* and 145*b*. The antennas 145 are each in communication with the server 101 via network 150.

The server 101 is further configured to wirelessly transmit the location information received from the tracking modules 102 on the train 110 to the vehicles 112*a* and 112*b*. More specifically, the vehicles 112*a* and 112*b* respectively include a train-detection module 103*a* and 103*b*. Each of the train-detection modules 103 is configured to wirelessly receive location information from the server 101 via one or more of the fixed antennas 145. In addition, each of the train-detection modules 103 is configured to determine location information for its own position based on information received from the GPS satellite 140, or some other source.

When one of the train-detection modules 103 determines that a collision with the train 110 is likely to occur, the train-detection module 103 alerts the operator of the corresponding vehicle. For example, vehicle 112*a* is traveling along the road 106 towards the intersection with the train track 115. The train-detection module 103*a* (positioned within the vehicle 112*a*) receives location information about the train 110 from the server 101. In addition, the train-detection module 103*a* determines information about the location of the vehicle 112*a*, based on the GPS satellite 140. Based on the location information about the train 110 and the vehicle 112*a*, the train-detection module 103*a* can determine whether a collision between the vehicle 112*a* and the train 110 is likely to occur.

Various approaches to determining, predicting, or otherwise identifying potential or likely collisions are described herein. In one example embodiment, the train-detection module 103*a* may track the current distance between the vehicle 112*a* and the train 110. When this distance drops below a threshold value (e.g., 1000 meters, 500 meters, 100 meters), the train-detection module 103*a* will alert the driver. Different thresholds may be used depending on the speed at which the vehicle 112*a* and/or the train 110 are traveling. For example, a higher threshold value may be used at high speeds, so as to provide the operator with more time to take evasive action. Furthermore, if the distance continues to decrease the alert may be intensified, such as by increasing volume or frequency.

In another example embodiment, the train-detection module 103*a* may predict, based on the position and velocity of the train 110 and the position and velocity of the vehicle 103*a*, times at which the vehicle and the train are likely to be in a particular intersection. If these times overlap, then a potential collision is indicated and the train-detection module 103*a* will initiate an alert. This and other approaches to detecting potential collisions will be discussed in more detail below.

Figure 2:
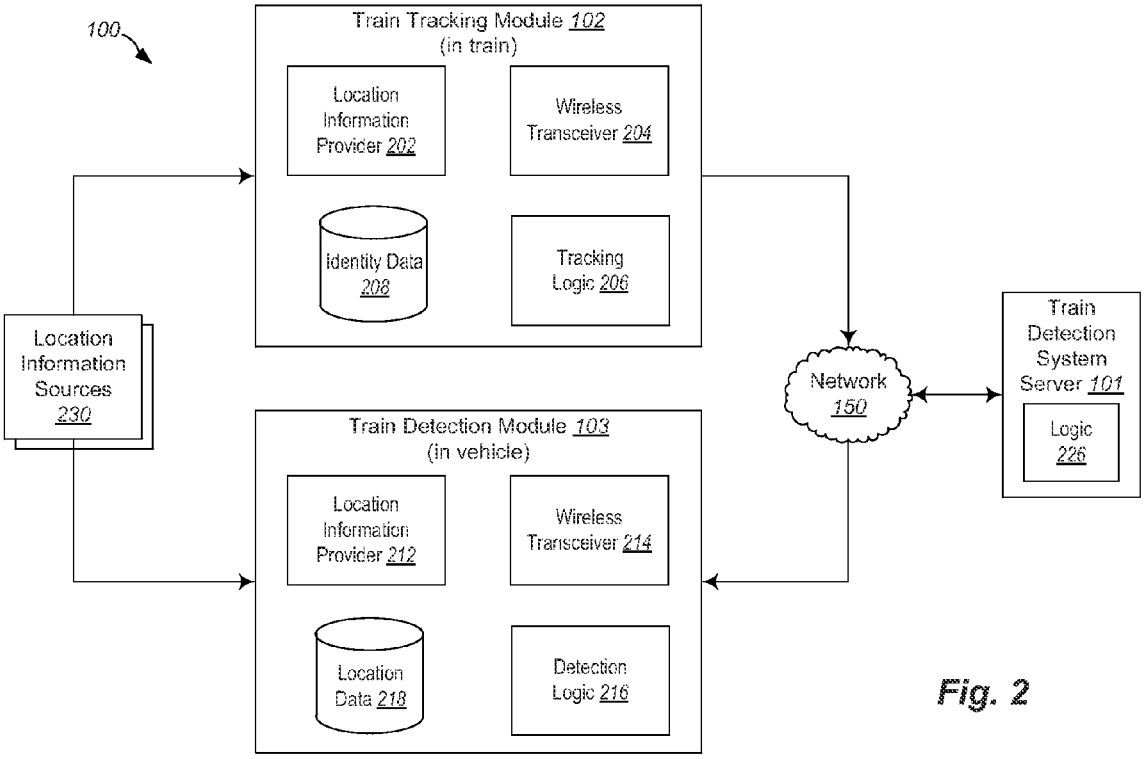
FIG. 2 is a functional block diagram of an example embodiment of a train detection system.

FIG. 2 is a functional block diagram of an example embodiment of a train detection system 100. The illustrated train detection system 100 includes a train-detection system server 101, a train-tracking module 102, and a train-detection module 103.

The train-tracking module 102 is typically positioned on a train and includes a location information provider 202, a wireless transceiver 204, tracking logic 206, and identity data 208. The location information provider 202 may be any module or component that is configured to determine location information with respect to the position of the train-tracking module 102. For example, the location information provider 202 may determine a latitude and longitude position based on a signal received from one or more location information sources 230.

The location information sources 230 include any sources of information that may be used to determine a location. For example, the location information sources 230 may include the GPS satellite 140 of FIG. 1. As another example, the location information sources 230 may include network components or elements that provide a network-based location. For example, a cellular network tower may provide a location corresponding to the tower that the location information provider 202 can access. In other embodiments, the location information provider 202 may be an access point for a Wi-Fi, DSRC ("Dedicated Short Range Communication"), or similar network that is configured to provide location information.

The wireless transceiver 204 may be any module or component that is configured to wirelessly transmit location information from the location information provider 202 to the train detection system server 101 via the network 150. In one embodiment, the transceiver 204 is a 3G or 4G cellular transceiver. In another embodiment, the transceiver 204 is a DSRC/802.11p or other short-range wireless transceiver.

Note that some embodiments may include only a transmitter in place of the transceiver 204. By using a transmitter rather than a transceiver, the train-tracking module 102 may be produced at a lower cost. In some embodiments, the a transceiver-based train-tracking module is installed in a locomotive of a train, while a lower-cost transmitter-only train-tracking module is installed in at the rear of the train. The transmitter-only train-tracking module may have a low power or short range transmitter configured to transmit location information to the transceiver-based tracking module, which is then responsible for forwarding the information to the server 101.

The tracking logic 206 may be any module or component that is configured to control the operation of the train-tracking module 102. The tracking logic 206 is typically configured to receive information from the location information provider 202 and to cause the wireless transceiver 204 to transmit that information to the server 101. The tracking logic 206 may perform other functions, such as determining a current velocity of the train-tracking module based 102 on one or more positions provided by the location information provider 202. The current velocity may also be transmitted to the server 101.

The identity data 208 includes a unique identifier of the train-tracking module 102 this identifier is transmitted along with location information to the server 101, so that location information may be associated with a particular train-tracking module 102 and/or its corresponding train.

The train-detection module 103 is typically positioned at a vehicle and includes a location information provider 212, a wireless transceiver 214, detection logic 216, and location data 218. The location information provider 212 and the wireless transceiver 214 respectively operate in a manner similar to the location information provider 202 and the wireless transceiver 204 described with respect to the train-tracking module 102, above.

The location data 218 stores location information that is provided by the location information provider 212 and that corresponds to the location of the train-detection module 103. The location data 218 also includes location information that is received from the server 101 and that corresponds to the location of the train-tracking module 102. The location information stored as the location data 212 may include point locations (e.g., latitude and longitude coordinates), two-dimensional locations (e.g., a point and radius representing a likely location), and the like. In addition, the location data 212 may include information regarding the speed and direction of travel the train-tracking module 102 and the train-detection module 103.

The location data 218 also includes map information that represents roads, railroads, and crossings. This map information may be used to correspond the vehicle and the train with respective roads and tracks. The map information may also be used to determine whether a road over which the train-detection module 103 is traveling will intersect or cross a track over which the train-tracking module 102 is traveling.

The detection logic 216 may be any module or component that is configured to identify or predict potential collisions between a train carrying the train-tracking module 102 and a vehicle carrying the train-detection module 103. The detection logic 216 uses location information and map information stored in location data 218 to make predictions about potential collisions between the vehicle and the train. For example, the detection logic 216 may first determine or identify a railroad crossing that is being approached via a road traveled by the vehicle. Then, based on the speed of the vehicle and its current position, the detection logic 216 may predict a time at which the vehicle is likely to be in the upcoming railroad crossing. Next, based on the speed of the train and its current position, the detection logic 216 may predict a time at which the train is likely to be in the upcoming railroad crossing. If these times overlap, or are within some determined or preselected margin or range, the detection logic 216 will alert the driver of the vehicle.

In one embodiment, the train-detection module 103 executes on, or is otherwise provided by, a smart phone, tablet computer, or other mobile computing device. In such an embodiment, the wireless transceiver 214 is the 3G/4G transceiver of the smart phone, and the GPS receiver is the location information provider 212. In other embodiments, the train-detection module 103 may be installed and/or integrated into a vehicle information system. For example, the location information provider 212 may be a GPS receiver that exists as part of an on-board navigation system in the vehicle, while the detection logic 216 may execute on an on-board computer of the vehicle.

The train detection system server 101 includes logic 226. The logic 226 is configured to receive location information from the train-tracking module 102 and forward that location information to the train-detection module 103. The logic 226 may also be configured to receive location information from the train-detection module 103. The logic 226 typically selectively forwards location information, based on the locations of trains and vehicles, so that vehicles only receive location information for trains that are within a certain distance (e.g., one km, five km). Such selective forwarding of location information reduces network load and/or computational overhead on the part of the train-detection module 103.

In some embodiments, the logic 226 also preprocesses, filters, or otherwise modifies information received from the train-tracking module 102. For example, the train-tracking module 102 may be configured to provide raw location information in the form of latitude and longitude coordinates. The logic 226 may then use this raw information to determine a velocity or direction of travel for the train, which is then transmitted to the train-tracking module 103 so as to reduce the computational overhead for the detection logic 216.

Note that the techniques and decomposition described with respect to FIGS. 1 and 2 may be modified in various ways. In some embodiments, the server logic 226 may perform one or more of the functions that are described as being performed by the train-tracking module 102 and/or the train-detection module 103. For example, the server logic 226 may determine whether a collision is likely to occur between a train and a vehicle, based on information received from the modules 102 and 103. If so, the logic 226 may transmit alerts to the module 102 and/or the module 103 so that operators of the corresponding train or vehicle can take appropriate action.

In addition, the train-detection module 103 and the train-tracking module 102 need not necessarily communicate via the server 101. For example, some embodiments may support a peer-to-peer or mesh architecture in which the modules 102 and 103 communicate directly with each other or possibly via some other peer module located in another vehicle or train.

Figure 3:
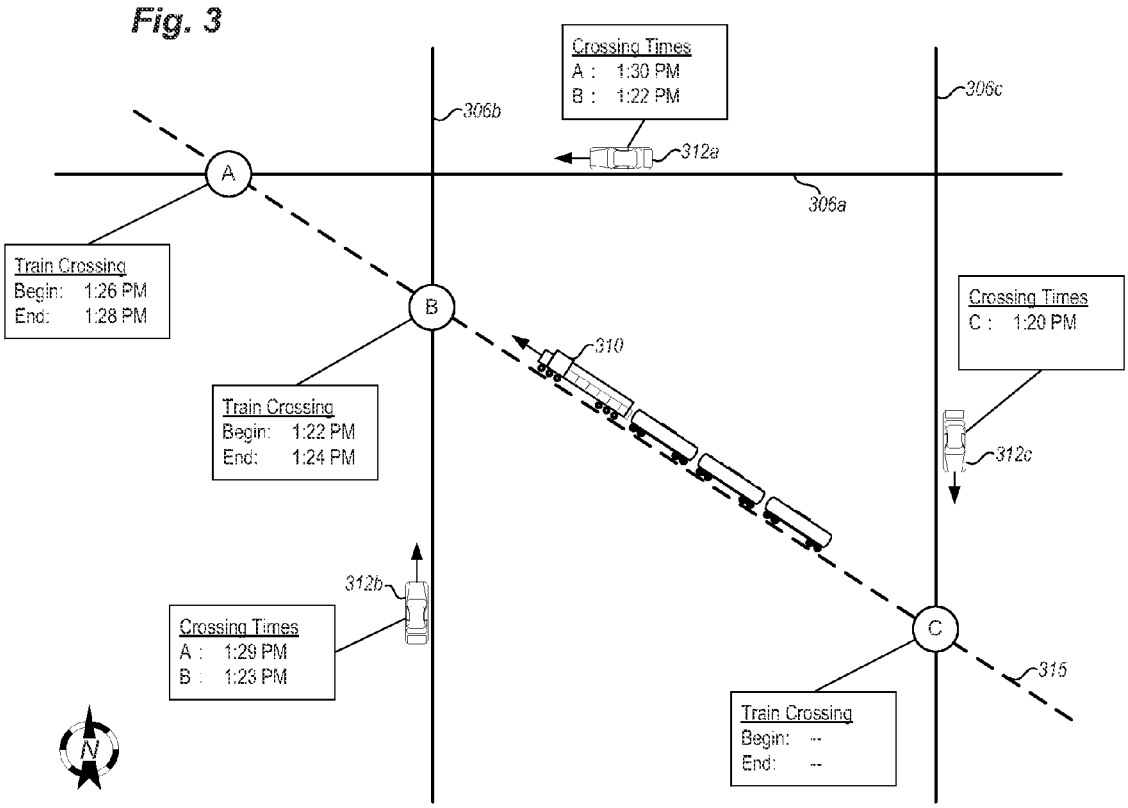
FIG. 3 illustrates predicted train crossing data produced and utilized by an example embodiment of a train detection system.

FIG. 3 illustrates predicted train crossing data produced and utilized by an example embodiment of a train detection system. More particularly, FIG. 3 illustrates one approach to determining whether a collision is likely to occur between a vehicle and train. Note that the techniques are below described as being performed generally by the train detection system 100. As discussed above, the allocation and decomposition of particular functions amongst the different components of the system 100 may take different forms in different embodiments. For clarity of explanation, these functions are below ascribed generally to the system 100.

FIG. 3 shows a network of three roads 306*a*-306*c* and a railroad track 315. A train 310 is traveling on the track 315 in a northwesterly direction. A vehicle is traveling on each of the roads 306*a*-306*c*. In particular, vehicle 312*a* is traveling westbound on road 306*a*, vehicle 312*b* is traveling northbound on road 306*b*, and vehicle 312*c* is traveling southbound on road 306*c*. Each of the roads 306*a*-306*c* intersects with the track 315. In particular, road 306*a* intersects with the track 315 at crossing A, road 306*b* intersects with the track 315 at crossing B, and road 306*c* intersects with the track 315 at crossing C.

In the illustrated example, the train detection system 100 determines train crossing times for each of the crossings A, B, and C. For example, with respect to crossing A, the system determines that the train 310 will enter the crossing at 1:26 PM and exit the crossing at 1:28 PM. With respect to crossing B, the system 100 determines that the train 310 will enter the crossing at 1:22 PM and exit the crossing at 1:24 PM. With respect crossing C, the system 100 determines that the train 310 is not approaching the crossing, and thus does not determine or record any crossing times for crossing C.

The illustrated train crossing times may be determined with reference to location information received from the train 310 together with map information. For example the location information received from the train 310 can be used to determine a current position and a current velocity for the train 310. The map information can be used to determine the locations of crossings A, B, and C. Note that the train 310 will typically provide information about its front end (e.g., locomotive) and rear end (e.g., caboose or last car). Based on the locations of the crossing and the locations of the front and rear of the train, the system 100 can determine a time at which the train is likely to enter and exit each crossing.

In the illustrated embodiment, the train detection system 100 also determines, for each of the vehicles 312, crossing times for upcoming railroad crossings. Upcoming railroad crossings may be determined based on location information provided by the vehicles 312 and map information. For example, with respect to vehicle 312*a*, crossings A and B may be identified as upcoming crossings, given that they are both along possible routes that may be traveled by the vehicle 312*a*. With respect to vehicle 312*b*, crossings A and B may also be identified as upcoming crossings. With respect to vehicle 312*c*, only crossing C may be identified as an upcoming crossing. By first identifying upcoming crossings, the computational overhead of detecting potential collisions may be reduced, because the system 100 need not compute crossing times for crossings that are not on a route currently being traveled by a particular car, of which there may be many. Of course, the system 100 periodically re-identifies upcoming crossings, based on changing conditions, such as the locations of the train 310 and/or the vehicles 312.

Having identified upcoming crossings for each of the vehicles 312, the system 100 can then determine a time corresponding to each crossing based on the position, speed, and direction of each of the vehicles 312. For example, with respect to vehicle 312*a*, the system 100 may determine that at the current rate of travel, the vehicle 312*a* is likely to enter crossing A at 1:30 PM and is likely to enter crossing B at 1:22 PM (if it should make a turn). With respect to vehicle 312*b*, the system 100 may determine that at the current rate of travel, the vehicle 312*b* is likely to enter crossing A at 1:29 PM (if it should make a turn) and is likely to enter crossing B at 1:23 PM. With respect to vehicle 312C the system 100 may determine that the vehicle is likely to enter crossing C at 1:20 PM. In some embodiments, the system 100 may elect not to determine a time for crossing C because there is no train predicted to be in the crossing at any time within some analysis window (e.g., the next five or ten minutes) used by the system 100.

In addition, note that the system 100 need not compute times for crossings that are not relevant to a given vehicle 312. For example the system 100 does not compute crossing times for crossings A or B with respect to vehicle 312*c*, because those crossings have not been identified as upcoming crossings for vehicle 312*c* based on its direction of travel.

Having computed vehicle and train crossing times, potential collisions may be readily identified. In particular, the system 100 may compare train crossing times for each crossing with crossing times computed for a given vehicle. For example with respect to crossing A, the system 100 may compare the crossing time of 1:30 PM for vehicle 312*a* with the train entry and exit times of 1:26 PM and 1:28 PM. In this example, the vehicle 312*a* will be entering the crossing A after the train 310 has exited the crossing, meaning that no alert need be given.

As another example, with respect to crossing B, the system 100 may compare the crossing time of 1:22 PM for vehicle 312*a* with the train entry and exit times of 1:22 PM and 1:24 PM. Here the vehicle 312*a* will be reaching crossing B at or about the same time that the train 310 will be entering the crossing, meaning that a collision is likely to occur. Similar operations may be performed to determine that vehicle 312*b* may collide with the train 310 at crossing B, because the vehicle 312*b* will reach crossing B at 1:23 PM, which is between the train entry and exit times of 1:22 and 1:24 PM. In addition, the system can determine that there is no risk of a collision for vehicle 312*c* at upcoming crossing C, because there are no trains due to enter or exit that crossing.

In some embodiments, the system may determine margins of error with respect to the computed times. For example, it is understood that vehicles frequently do not travel a consistent rate of speed. Thus, the system may calculate a time range during which a vehicle is likely to be within a crossing. If a time range for a vehicle overlaps a crossing time range for a train, then a likely collision may be indicated. The margins of error may be based on other information as well. For example, the system 100 may consider factors such as weather conditions, traffic conditions, posted speed limits, and the like, in order to predict travel times between current locations and upcoming railroad crossings.

In some embodiments, the system 100 considers historical information, such as previous routes of travel, in order to improve its predictive capabilities. For example, the system 100 may elect to delay issuing an alert to vehicle 312*a* with respect to a potential collision at crossing B, due to the fact that the vehicle 312*a* rarely turns onto road 306*b*.

Figure 4:
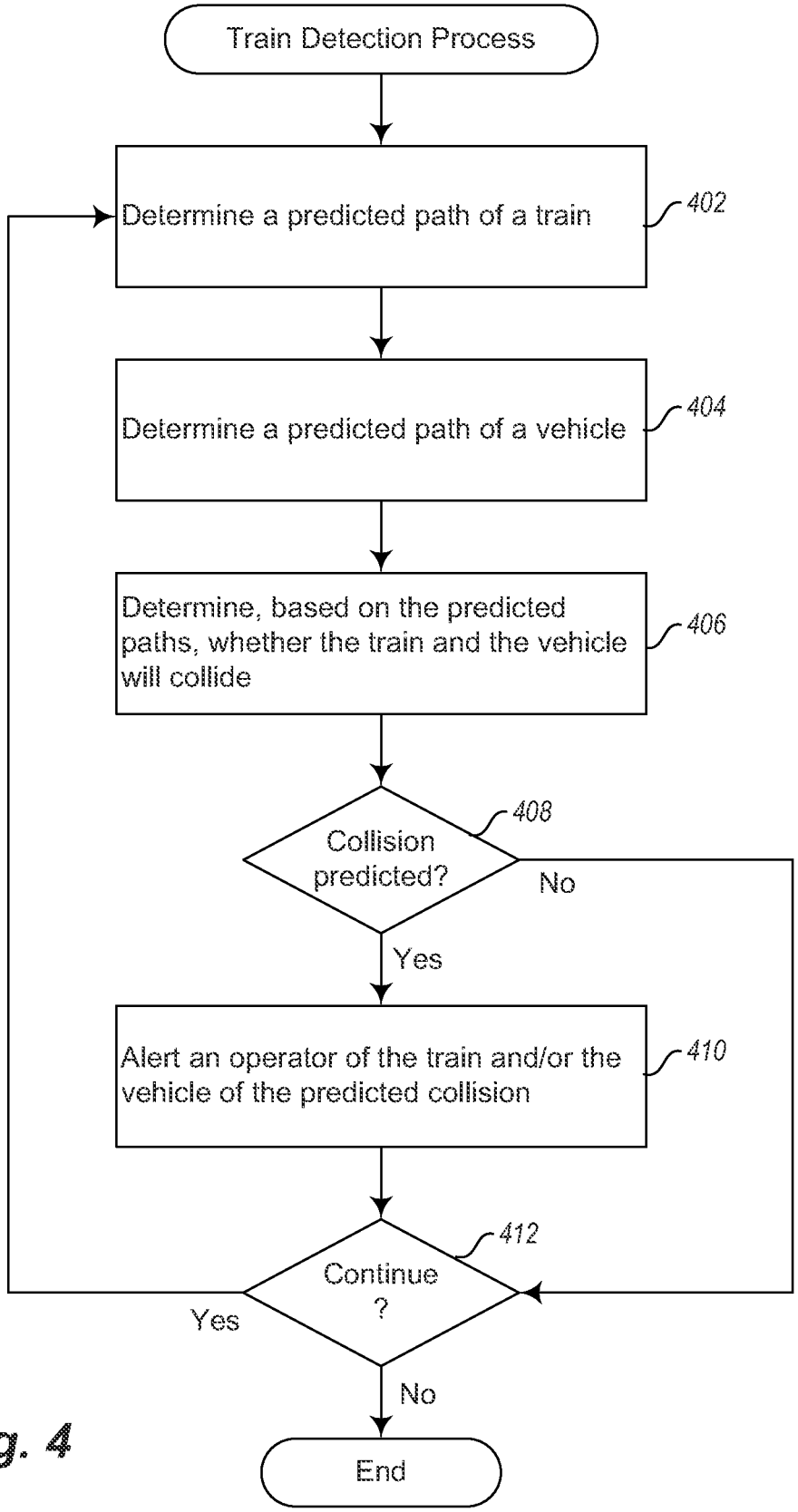
FIG. 4 is a flow diagram that illustrates an example train detection process.

FIG. 4 is a flow diagram that illustrates an example train detection process 400. The illustrated process 400 may be performed by one or more elements of the train detection system 100. In one embodiment, the process 400 is performed primarily by the train-detection module 103. In other embodiments, the process 400 may be performed by the train detection system server 101 and/or the train-tracking module 102.

The process begins at block 402, where it determines the predicted path of a train. Determining the predicted path may include determining or receiving location information that indicates, describes, or represents the current location of the train. Determining the predicted path may also or instead include determining or receiving a current velocity of the train. Determining the predicted path may also or instead include associating the current location of the train with a particular track, based on map information.

At block 404, the process determines a predicted path of the vehicle. Determining the predicted path may include receiving or determining a current vehicle location, velocity, and/or direction of travel. Determining the predicted path may also include associating the current location of the vehicle with a particular road, based on map information. Note that multiple paths may be predicted and analyzed, based on the topology of the road network.

At block 406, the process determines, based on the predicted paths, whether the train and the vehicle will collide or have an unacceptable risk of collision. As discussed above, determining a potential collision may be performed in various ways. In some embodiments, a potential collision may be identified solely based on proximity between the vehicle and the train. Other embodiments may take other factors into account, including the direction of travel, the rate of travel, and the like. Some embodiments may identify an upcoming railroad crossing and then determine times at which the vehicle and the train are likely to be in or about the upcoming crossing. If those times overlap a collision is likely.

At block 408, the process determines whether a collision is predicted based on the determination made at block 406, above. If a collision is predicted, the process proceeds to block 410, otherwise to block 412.

At block 410, the process alerts an operator of the train and/or the vehicle of the predicted collision. Alerting the operator of the predicted collision may include initiating an audio, visual, or tactile warning, such as by sounding an alarm, flashing a light, or the like. In some embodiments, the warnings may progressively intensify as the risk of collision increases. For example, if the process predicts that a collision may occur in one minute, a low volume alarm may be sounded. However, as time passes and the collision appears to be more imminent (e.g., the vehicle is not slowing down or turning), the alarm volume or frequency may be increased, or other types of alerts (e.g., flashing lights) may be initiated. In some embodiments, the process may be configured to interact directly with the vehicle, such as by causing an alarm to be played via the speakers of the vehicle, by applying the brakes of the vehicle, by reducing engine output, or the like.

At block 412, the process determines whether to continue, and if so, returns to block 402, otherwise ends. Typically, the process runs continuously while a vehicle is in operation, so that potential collisions may be detected based on changing locations of vehicles and trains. In some embodiments, the process may suspend or sleep when there are no crossings within a specified distance (e.g., two km, five km). In such cases, the process may be configured to awake after a particular time or distance has elapsed.

Figure 5:
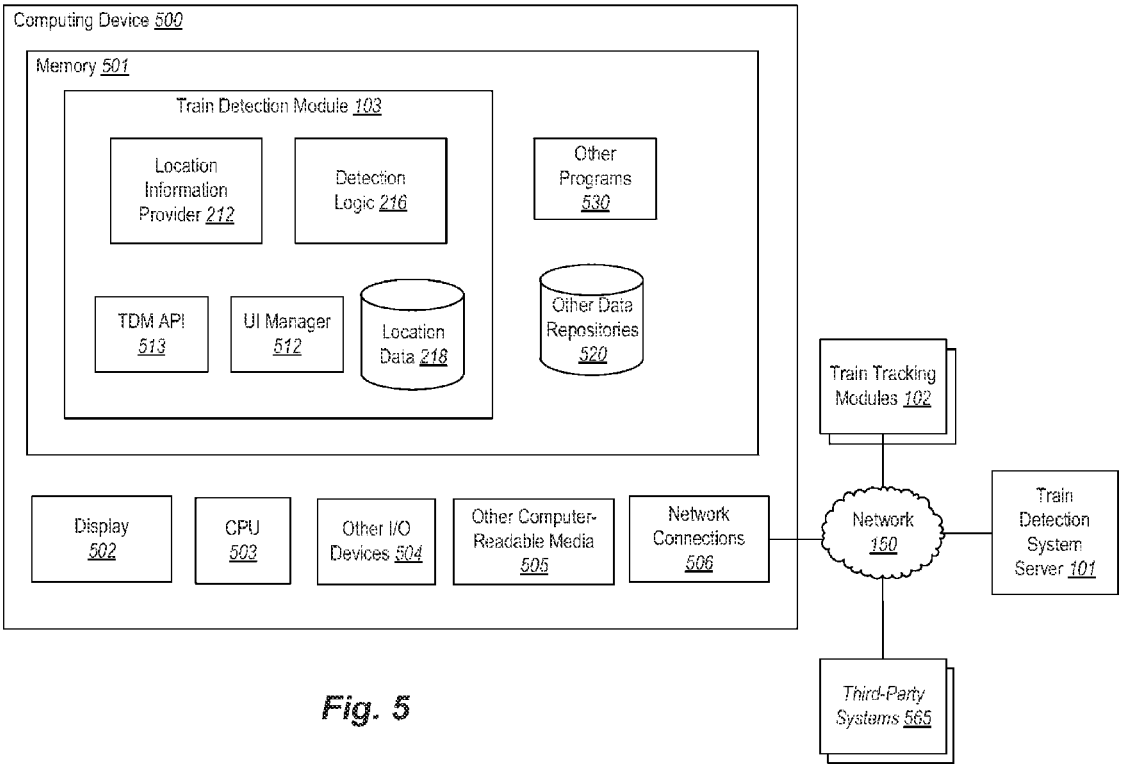
FIG. 5 is a block diagram of an example computing system for implementing a train detection system according to an example embodiment.

FIG. 5 is a block diagram of an example computing system for implementing a train detection system according to an example embodiment. In particular, FIG. 5 shows a computing device 500 that may be utilized to implement an embodiment of a train-detection module 103. Similar techniques may be utilized to implement other elements of the train detection system 100, including the server 101 and the train-tracking module 102.

Note that one or more general purpose or special purpose computing systems/devices may be used to implement the train-detection module 103. In addition, the computing system 100 may comprise one or more distinct computing systems/devices and may span distributed locations. Furthermore, each block shown may represent one or more such blocks as appropriate to a specific embodiment or may be combined with other blocks. Also, the train-detection module 103 may be implemented in software, hardware, firmware, or in some combination to achieve the capabilities described herein.

In the embodiment shown, computing system 500 comprises a computer memory ("memory") 501, a display 502, one or more Central Processing Units ("CPU") 503, Input/Output devices 504 (e.g., GPS receiver, keyboard, mouse, display), other computer-readable media 505, and network connections 506 connected to a network 150. The train-detection module 103 is shown residing in memory 501. In other embodiments, some portion of the contents, some or all of the components of the train-detection module 103 may be stored on and/or transmitted over the other computer-readable media 505. The components of the train-detection module 103 preferably execute on one or more CPUs 503 and facilitate train detection processes as described herein. Other code or programs 530 (e.g., an administrative interface, a Web browser, and the like) and potentially other data repositories, such as data repository 520, also reside in the memory 501, and preferably execute on one or more CPUs 503. Of note, one or more of the components in FIG. 5 may not be present in any specific implementation. For example, some embodiments may not provide other computer readable media 505 or a display 502.

The example train-detection module 103 includes a location information provider 212, detection logic 216, a user interface ("UI") manager 512, a train-detection module application program interface ("API") 513, and location data 218. The location information provider 212 and detection logic 216 are software modules that perform functions as described with respect to FIG. 2, above. The location information provider may interact with a GPS receiver operating as one of the I/O devices 504.

The UI manager 512 provides a view and a controller that facilitate user interaction with the train-detection module 103 and its various components. For example, the UI manager 512 may provide interactive access to the train-detection module 103, such that users can specify preferred alert types, preferred travel routes, error margins, and the like.

The API 513 provides programmatic access to one or more functions of the train-detection module 103. For example, the API 513 may provide a programmatic interface to one or more functions of the train-detection module 103 that can be invoked by one of the other programs 530 or some other module. In this manner, the API 513 facilitates the development of third-party software, such as user interfaces, plug-ins, adapters (e.g., for integrating functions of the train-detection module 103 into a larger vehicle information system), and the like.

In addition, the API 513 may be in at least some embodiments invoked or otherwise accessed via remote entities, such as the server 101 or the third-party system 165, to access various functions of the train-detection module 103. For example, the server 101 may push train location information to the train-detection module 103 via the API 513. As another example, a map provider executing as the third-party system 165 may automatically provide map updates to the train-detection module 103.

The location data store 218 is used by the modules of the train-detection module 103 to store and/or communicate information. As noted above, the components of the train-detection module 103 use the data store 218 to record various types of information, including train and vehicle location information, map information, and the like. Although the components of the train-detection module 103 are described as communicating primarily through the data store 218, other communication mechanisms are contemplated, including message passing, function calls, pipes, sockets, shared memory, and the like.

The train-detection module 103 interacts via the network 150 with train-tracking modules 102, the train detection system server 101, and third-party systems 165. The network 150 may be any combination of one or more media (e.g., twisted pair, coaxial, fiber optic, radio frequency), hardware (e.g., routers, switches, repeaters, transceivers), and one or more protocols (e.g., TCP/IP, UDP, Ethernet, DSRC, Wi-Fi, WiMAX, 3G, 4G) that facilitate communication between remotely situated humans and/or devices. In some embodiments, the network 150 may be or include multiple distinct communication channels or mechanisms (e.g., cable-based and wireless).

In an example embodiment, components/modules of the train-detection module 103 are implemented using standard programming techniques. For example, the train-detection module 103 may be implemented as a "native" executable running on the CPU 103, along with one or more static or dynamic libraries. In other embodiments, the train-detection module 103 may be implemented as instructions processed by a virtual machine that executes as one of the other programs 530. In general, a range of programming languages known in the art may be employed for implementing such example embodiments, including representative implementations of various programming language paradigms, including but not limited to, object-oriented (e.g., Java, C++, C#, Visual Basic.NET, Smalltalk, and the like), functional (e.g., ML, Lisp, Scheme, and the like), procedural (e.g., C, Pascal, Ada, Modula, and the like), scripting (e.g., Perl, Ruby, Python, JavaScript, VBScript, and the like), and declarative (e.g., SQL, Prolog, and the like).

The embodiments described above may also use either well-known or proprietary synchronous or asynchronous client-server computing techniques. Also, the various components may be implemented using more monolithic programming techniques, for example, as an executable running on a single CPU computer system, or alternatively decomposed using a variety of structuring techniques known in the art, including but not limited to, multiprogramming, multithreading, client-server, or peer-to-peer, running on one or more computer systems each having one or more CPUs. Some embodiments may execute concurrently and asynchronously, and communicate using message passing techniques. Equivalent synchronous embodiments are also supported. Also, other functions could be implemented and/or performed by each component/module, and in different orders, and by different components/modules, yet still achieve the described functions.

In addition, programming interfaces to the data stored as part of the train-detection module 103, such as in the location data store 218, can be available by standard mechanisms such as through C, C++, C#, and Java APIs; libraries for accessing files, databases, or other data repositories; through scripting languages such as XML; or through Web servers, FTP servers, or other types of servers providing access to stored data. The data store 218 may be implemented as one or more database systems, file systems, or any other technique for storing such information, or any combination of the above, including implementations using distributed computing techniques.

Different configurations and locations of programs and data are contemplated for use with techniques described herein. A variety of distributed computing techniques are appropriate for implementing the components of the illustrated embodiments in a distributed manner including but not limited to TCP/IP sockets, RPC, RMI, HTTP, Web Services (XML-RPC, JAX-RPC, SOAP, and the like). Other variations are possible. Also, other functionality could be provided by each component/module, or existing functionality could be distributed amongst the components/modules in different ways, yet still achieve the functions described herein.

Furthermore, in certain embodiments, some or all of the components of the train-detection module 103 may be implemented or provided in other manners, such as at least partially in firmware and/or hardware, including, but not limited to one or more application-specific integrated circuits ("ASICs"), standard integrated circuits, controllers executing appropriate instructions, and including microcontrollers and/or embedded controllers, field-programmable gate arrays ("FPGAs"), complex programmable logic devices ("CPLDs"), and the like. Some or all of the system components and/or data structures may also be stored as contents (e.g., as executable or other machine-readable software instructions or structured data) on a computer-readable medium (e.g., as a hard disk; a memory; a computer network or cellular wireless network or other data transmission medium; or a portable media article to be read by an appropriate drive or via an appropriate connection, such as a DVD or flash memory device) so as to enable or configure the computer-readable medium and/or one or more associated computing systems or devices to execute or otherwise use or provide the contents to perform at least some of the described techniques. Some or all of the components and/or data structures may be stored in a non-transitory manner on tangible, non-transitory storage mediums. Some or all of the system components and data structures may also be stored as data signals (e.g., by being encoded as part of a carrier wave or included as part of an analog or digital propagated signal) on a variety of computer-readable transmission mediums, which are then transmitted, including across wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of this disclosure may be practiced with other computer system configurations.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A system configured to facilitate detection and avoidance of potential collisions between trains and vehicles, comprising:

a first tracking module carried by a train;

a train-detection module that is carried by a vehicle, that includes a vehicle positioning system receiver, and that is configured to:

receive train location information from the first tracking module;

determine vehicle location information based on information provided by the vehicle positioning system receiver;

determine, based on the train location information and the vehicle location information, whether the train and the vehicle are likely to collide; and when it is determined that the train and the vehicle are likely to collide, alert an operator of the vehicle of a potential collision with the train; and a train detection server computing system that is configured to:

receive the train location information from the first tracking module;

determine one or more train-detection modules that are within a specified distance of the first tracking module; and transmit train location information received from the first tracking module to the determined one or more train-detection modules.

2. The system of claim 1, wherein first tracking module includes a vehicle positioning system receiver that is configured to determine latitude and longitude coordinates for the train.

3. The system of claim 1, wherein the first tracking module is located at the front end of the train, and further comprising a second tracking module located at the rear end of the train, wherein the train-detection module is further configured to:

determine an interval of time during which the train will be in a crossing based on location information received from both the first and second tracking module.

4. The system of claim 1, wherein the train-detection module is a software module that executes on a smart phone that is located within the vehicle and that is configured to wirelessly receive the train location information via a 3G/4G wireless transceiver.

5. The system of claim 1, wherein the train-detection module is configured to receive the train location information directly from the tracking module, without passing through the train detection server.

6. The system of claim 1, wherein the train-detection module is configured to determine whether the train and the vehicle are likely to collide based on whether a current distance between the train and the vehicle is below a threshold distance, wherein the current distance is determined based on a current position of the train and a current position of the vehicle.

7. The system of claim 1, wherein the train-detection module is configured to determine whether the train and the vehicle are likely to collide based on whether the train and the vehicle are predicted to be within an upcoming train crossing at or about a same time.

8. A method for facilitating detection and avoidance of potential collisions between trains and vehicles, comprising:

at a train-detection module that is carried by a vehicle that includes a vehicle positioning system receiver:

receiving train location information from a first tracking module carried by a train;

determining vehicle location information based on information provided by the vehicle positioning system receiver;

determining, based on the train location information and the vehicle location information, whether the train and the vehicle are likely to collide; and when it is determined that the train and the vehicle are likely to collide, alerting an operator of the vehicle of a potential collision with the train; and at a train detection server computing system:

receiving the train location information from the first tracking module;

determining one or more train-detection modules that are within a specified distance of the first tracking module; and transmitting train location information received from the first tracking module to the determined one or more train-detection modules.

9. The method of claim 8, further comprising:

determining whether the predicted paths will result in a collision; and when the predicted paths will result in a collision, alerting the operator of the vehicle of the potential collision with the train.

10. The method of claim 8, wherein determining whether the predicted paths will result in the collision includes:

determining a current distance between the vehicle and the train, based on the train location information and the vehicle location information;

determining whether the current distance is decreasing as compared to a previously determined current distance; and determining whether the current distance is below a threshold value.

11. The method of claim 8, wherein determining whether the predicted paths will result in the collision includes:

determining, based on the train location information, a track being traveled by the train;

determining, based on the vehicle location information, a road being traveled by the vehicle;

identifying an upcoming crossing between the track and the road;

determining a first time at which the train will be within the upcoming crossing;

determining a second time at which the vehicle will be within the upcoming crossing;

when the first and second times match, providing a notification that the predicted paths will result in a collision.

12. The method of claim 11, wherein determining the first and second times includes:

determining the first time based on a distance between the train and the upcoming crossing together with a current velocity of the train;

determining a second time based on a distance between the vehicle and the upcoming crossing together with a current velocity of the vehicle.

13. The method of claim 11, wherein determining the first time includes:

determining a time range during which the train is likely to be within the upcoming crossing, the time range based on train location information provided by a first tracking module positioned at the front of the train and train location information provided by a second tracking module positioned at the rear of the train.

14. The method of claim 11, wherein determining the second time includes:

determining a time range during which the vehicle is likely to be within the upcoming crossing, the time range based on one or more of: a posted speed limit along the road, average speeds observed along the road, traffic conditions along the road, and weather conditions along the road.

* * * * *